US011024475B2

(12) United States Patent
Heiskanen et al.

(10) Patent No.: US 11,024,475 B2
(45) Date of Patent: Jun. 1, 2021

(54) WATERPROOF SWITCH

(71) Applicants: Huawei Technologies Co., Ltd., Shenzhen (CN); Juuso Heiskanen, Helsinki (FI)

(72) Inventors: Juuso Heiskanen, Helsinki (FI); Jari Lamminparras, Helsinki (FI)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 38 days.

(21) Appl. No.: 16/498,216

(22) PCT Filed: Mar. 27, 2017

(86) PCT No.: PCT/EP2017/057213
§ 371 (c)(1),
(2) Date: Sep. 26, 2019

(87) PCT Pub. No.: WO2018/177502
PCT Pub. Date: Oct. 4, 2018

(65) Prior Publication Data
US 2020/0243276 A1 Jul. 30, 2020

(51) Int. Cl.
*H01H 13/06* (2006.01)
*H01H 13/14* (2006.01)

(52) U.S. Cl.
CPC ..... *H01H 13/06* (2013.01); *H01H 13/14* (2013.01); *H01H 2215/004* (2013.01); *H01H 2223/002* (2013.01); *H01H 2223/014* (2013.01)

(58) Field of Classification Search
CPC .. H01H 13/06; H01H 13/14; H01H 2215/004; H01H 2223/002
USPC ..... 200/302.2
See application file for complete search history.

(56) References Cited

U.S. PATENT DOCUMENTS

| | | | | |
|---|---|---|---|---|
| 5,258,592 | A | 11/1993 | Nishikawa et al. | |
| 9,360,894 | B1 * | 6/2016 | Lin | H04B 1/3888 |
| 2012/0067711 | A1 * | 3/2012 | Yang | H05K 5/069 200/341 |
| 2014/0162483 | A1 | 6/2014 | Chu | |
| 2015/0027868 | A1 | 1/2015 | Gao | |
| 2017/0064053 | A1 | 3/2017 | Ma et al. | |

FOREIGN PATENT DOCUMENTS

| | | | |
|---|---|---|---|
| CN | 101430976 | A | 5/2009 |
| CN | 201590359 | U | 9/2010 |
| CN | 203466107 | U | 3/2014 |
| CN | 205565144 | U | 9/2016 |

(Continued)

OTHER PUBLICATIONS

Machine Translation and Abstract of Chinese Publication No. CN205565144, Sep. 7, 2016, 5 pages.

(Continued)

*Primary Examiner* — Edwin A. Leon
*Assistant Examiner* — Iman Malakooti
(74) *Attorney, Agent, or Firm* — Conley Rose, P.C.

(57) ABSTRACT

A sealed switch having a switch body with first and second switch body sections, a switch contact configured to be disposed in a slot in the first switch body section, a switch contact cover configured to cover the slot, and a seal configured to cover the circumference of the second switch body section.

21 Claims, 3 Drawing Sheets

(56) References Cited

FOREIGN PATENT DOCUMENTS

| | | |
|---|---|---|
| JP | H0578557 U | 10/1993 |
| JP | H05308195 A | 11/1993 |

OTHER PUBLICATIONS

Foreign Communication From a Counterpart Application, PCT Application No. PCT/EP2017/057213, International Search Report dated Nov. 27, 2017, 5 pages.

Foreign Communication From a Counterpart Application, PCT Application No. PCT/EP2017/057213, Written Opinion dated Nov. 27, 2017, 6 pages.

* cited by examiner (a)

(b)

WATERPROOF SWITCH

CROSS-REFERENCE TO RELATED APPLICATIONS

This application is a U.S. National Stage of International Patent Application No. PCT/EP2017/057213 filed on Mar. 27, 2017, which is hereby incorporated by reference in its entirety.

TECHNICAL FIELD

The disclosure relates to a switch provided with sealing means and a button structure comprising such a switch.

BACKGROUND

Waterproof electronic devices are becoming increasingly popular. The interior of such a device has to be protected against ingress of water in order to avoid damaging the electronic components of the device. By adding waterproofing elements to every aperture or gap in an electronic device, the assembly becomes more complex and more space consuming.

An existing waterproof switch apparatus comprises a push button, a switch, and an elastic sheet arranged between the push button and the switch in order to protect the interior of an electronic device from ingress of water. The elastic sheet is provided with at least one an aperture such that the sheet can be press-fitted onto a shaft portion of the push-button. This solution allows the waterproofing element, i.e. the elastic sheet, to be arranged partially around the push-button such that the space consumption and the thickness of the switch apparatus is reduced.

However, an increased number of components and assembly steps results in large tolerance stack up between a push-button and its corresponding switch, impairing the tactile qualities of the push-button. The tactile qualities of the push-button are also impaired when placing the waterproofing element between push-button and switch. Also, the added friction caused by the waterproofing element increases the risk of the push-button jamming.

Accordingly, it would be desirable to be able to provide a waterproof switch apparatus that addresses at least some of the problems identified above.

SUMMARY

It is an object to provide an improved switch which is waterproof, and which has reduced components.

It is another object to provide a button structure including the improved switch.

The foregoing and other objects are achieved by the features of the independent claims. Further implementation forms are apparent from the dependent claims, the description, and the figures.

According to a first aspect, there is provided a switch comprising a switch body, having a first switch body section and a second switch body section, a switch contact configured to be arranged in a slot in the first switch body section, a switch contact cover configured to cover the slot, and a sealing means configured to cover a circumference of the second switch body section. Thus switch manufacture, as well as subsequent mounting into an electronic device, is facilitated due to a reduction in components. Further the tactile qualities of the push button which is corresponding to the switch is improved.

In a first possible implementation form of the first aspect, the first switch body section has a larger cross-section than the second switch body section. This facilitates fitting the sealing means onto only a section of the switch body, since the sealing means is naturally delimited by a step caused by the change in cross-section.

In a second possible implementation form of the first aspect, the switch contact comprises a dome.

In a third possible implementation form of the first aspect, the sealing means comprises a gasket.

In a fourth possible implementation form of the first aspect, the sealing means comprises a circumferentially extending ridge.

In a fifth possible implementation form of the first aspect, the sealing means is molded onto the switch body by means of injection molding.

According to a second aspect, there is provided a button structure for an electronic device, the electronic device comprising a housing having an external surface and an internal surface, the surfaces being connected by a through-going opening, wherein the button structure comprises a push-button, a switch according to the above, and a flex assembly, the switch being configured to extend at least partially through the opening between the push-button and the flex assembly. Thus tactility is increased and the risk of button jamming is reduced in comparison with prior art solutions wherein the sealing means is arranged between the push button and the switch. Further, the waterproofing surfaces in the housing may be machined at the same time as the through-going opening, which results in short tolerance stack up between the push-button and the switch.

In a first possible implementation form of the second aspect, the switch is electrically connected to the flex assembly.

In a second possible implementation form of the second aspect, the switch is connected to the flex assembly by means of soldering.

In a third possible implementation form of the second aspect, the sealing means is configured to seal the opening from ingress of fluid into the electronic device in a direction from the external surface to the internal surface.

In a fourth possible implementation form of the second aspect, the switch is configured to be inserted into the opening in a direction from the internal surface, and the flex assembly is configured to abut the internal surface. This solution keeps the switch in place within the through-going opening, hindering the switch from moving in a direction towards the external surface.

In a fifth possible implementation form of the second aspect, the button structure further comprises a support plate configured to lock the flex assembly to the housing. This solution hinders the switch from moving in a direction towards the internal surface.

According to a third aspect, there is provided an electronic device configured to receive a button structure according to the above, the electronic device comprising a housing having a first external surface, a second external surface, a third external surface, and an internal surface, the first external surface and the internal surface being connected by a through-going opening, the button structure being configured to extend at least partially through the opening.

Such an electronic device will not only be waterproof, but also maintain push-button tactility and hence user satisfaction.

In a first possible implementation form of the third aspect, the second external surface extends perpendicular to the first external surface and a first groove extends from the second external surface to the opening, the first groove being configured to receive a button lock plate adapted for interlocking a push-button of the button structure with the button lock plate such that the push-button cannot be removed from the opening without removing the button lock plate from the first groove. This solution keeps the push-button from moving in a direction towards the external surface of the housing.

In a second possible implementation form of the third aspect, the third external surface extends in parallel with the second external surface and a second groove extends from the third external surface to the opening, the second groove being configured to receive a support plate adapted for interlocking housing with the support plate such that the button structure cannot be removed from the opening without removing the support plate from the second groove.

According to a fourth aspect, there is provided a method of providing an electronic device with a button structure according to the above, the electronic device comprising a housing having a first external surface and an internal surface, the surfaces being connected by a through-going opening, the method comprising the steps of inserting the push-button partially into the opening, attaching the push-button to the housing, inserting the switch at least partially into the opening, in a direction from the internal surface towards the first external surface, such that the flex assembly, connected to the switch, abuts the internal surface, attaching the switch and the flex assembly to the housing. This method increases the tactility of the push-button and reduces the risk of button jamming in comparison with prior art solutions wherein the sealing means is arranged between the push button and the switch. Further, the waterproofing surfaces in the housing may be machined at the same time as the through-going opening, which results in short tolerance stack up between the push-button and the switch.

In a first possible implementation form of the fourth aspect, the method comprises inserting the push-button into the opening in a direction from the first external surface towards the internal surface. Such a solution allows for simple and quick mounting of the different components.

In a second possible implementation form of the fourth aspect, the housing further comprises a second external surface extending perpendicular to the first external surface, a first groove extending from the second external surface to the opening, and the method comprises inserting a button lock plate into the first groove, the push-button interlocking with the button lock plate such that the push-button cannot be removed from the opening without removing the button lock plate from the first groove.

In a third possible implementation form of the fourth aspect, the housing further comprises a third external surface extending in parallel with the second external surface, a second groove extending from the third external surface to the opening, and the method comprises inserting a support plate into the second groove, the support plate interlocking with the housing such that the button structure cannot be removed from the opening without removing the support plate from the second groove.

These and other aspects will be apparent from the embodiments described below.

BRIEF DESCRIPTION OF THE DRAWINGS

In the following detailed portion of the present disclosure, the aspects, embodiments and implementations will be explained in more detail with reference to the example embodiments shown in the drawings, in which.

DETAILED DESCRIPTION

Figure 1:
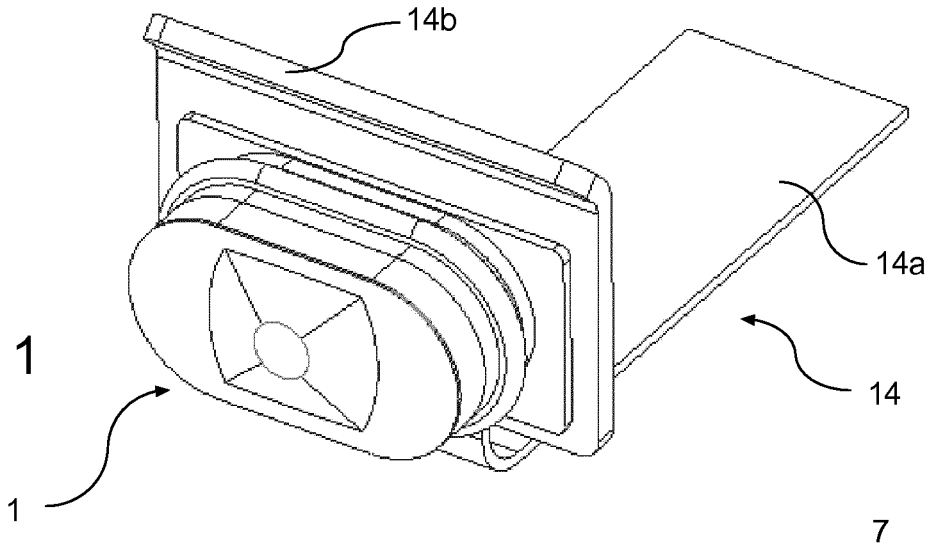
FIG. 1 shows an elevated view of a switch and a flex assembly in accordance with one embodiment of the present invention.

FIG. 1 shows an embodiment comprising a switch 1 and a flex assembly 14. The switch 1 is electrically connected to the flex assembly 14, for example by means of reflow soldering. The flex assembly 14 comprises an L-shaped flex 14*a* and a flex stiffener 14*b* which not only stiffens the flex 14*a* but also guides a support plate 15 arranged behind the stiffener 14*b* when the switch 1 is mounted in an electronic device. The switch comprises a switch body 2, a switch contact 3, a switch contact cover 5, and sealing means 6.

Figure 2:
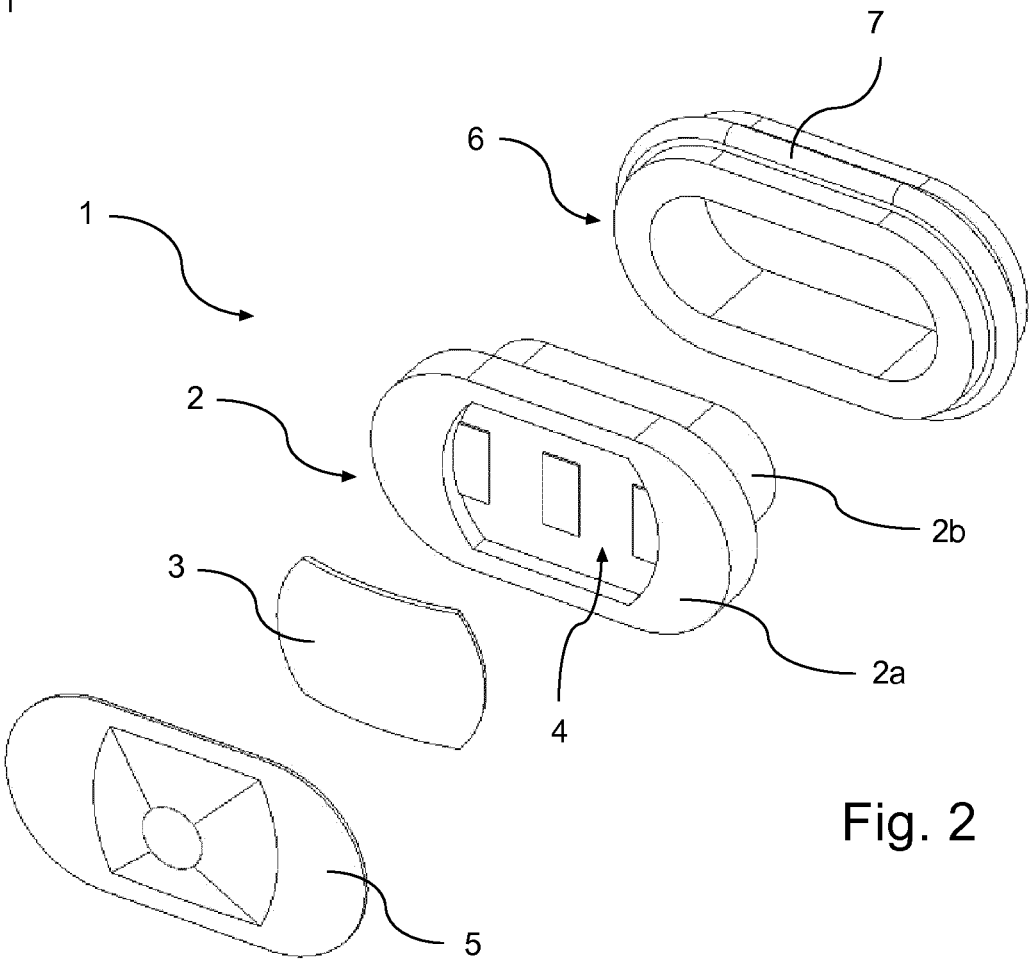
FIG. 2 shows an exploded and elevated view of the switch in the embodiment shown in FIG. 1.

The switch body 2 comprises plastic material and is preferably manufactured by means of insert molding. Further, the switch body 2 is provided with stamped metal inserts used together with signal lines which are soldered onto the flex 14*a*. As shown in FIG. 2, the switch body comprises of two sections, a first switch body section 2*a* and a second switch body section 2*b*, arranged along the center axis of the switch body 2. The metal inserts are mainly located in the second switch body section 2*b*.

In one embodiment, the first switch body section 2*a* has cross-section which is larger than that of the second switch body section 2*b*. The area of both sections is rectelliptical when seen in the direction of the switch center axis. By rectelliptical is meant a rectangular shape having rounded corners. The cross-section could also have any other suitable shape such as an elliptical, oval, or rectangular area. I.e., a side cross-sectional view of the switch reveals an essentially T-shaped switch body, while a frontal or rear cross-sectional view reveals one or two rectellipses, depending on if the cut has been made through the first switch body section 2*a* or the second switch body section 2*b*.

The switch contact 3, in one embodiment comprising a dome, is configured to be arranged in a slot 4 arranged at the free end of the first switch body section 2*a*. A switch contact cover 5 is provided to cover the switch contact/dome 3 and the slot 4, e.g. by means of laser welding or adhering the switch contact cover 5 to the above mentioned free end.

A sealing means 6, in one embodiment a gasket, covers the circumference of the second switch body section 2*b*. The sealing means/gasket 6 comprises a circumferentially extending ridge 7. The sealing means/gasket 6 can be a separate rubber component to be slid onto the switch body, or can be molded directly onto the switch body 2, preferably the second switch body section 2*b*, by means of liquid injection molding.

Figure 3:
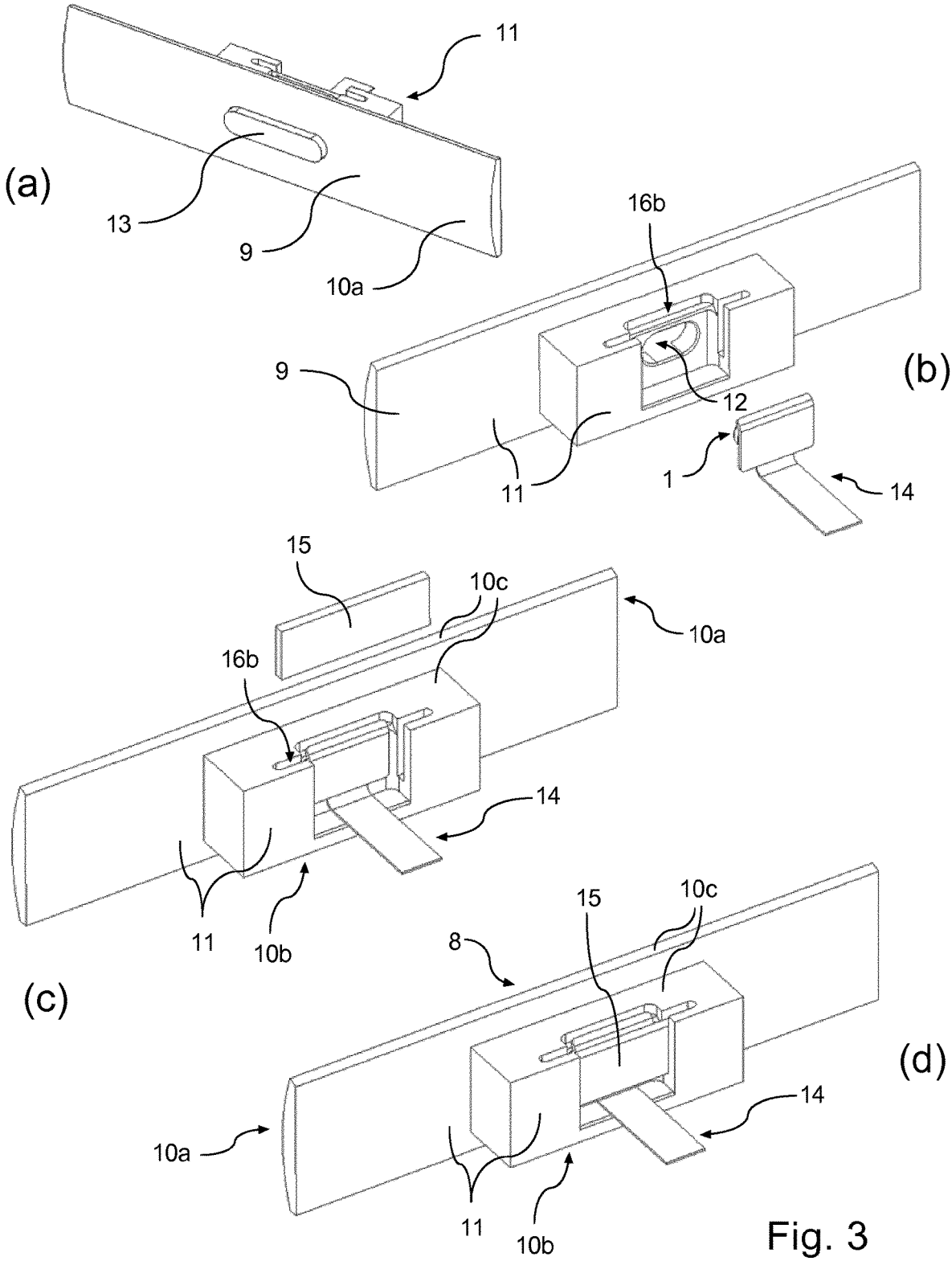
FIG. 3*a* shows an elevated front view of a button structure and a partial housing in accordance with another embodiment of the present invention.
FIG. 3*b* shows an elevated rear view of the embodiment shown in FIG. 3*a*, with switch and flex assembly separated from the housing.
FIG. 3*c* shows an elevated rear view of the embodiments shown in FIGS. 3*a* and 3*b*, with switch and flex assembly removably inserted into an opening in the housing.
FIG. 3*d* shows an elevated rear view of the embodiments shown in FIGS. 3*a* to 3*c*, with switch and flex assembly inserted and locked into an opening in the housing.
Figure 4:
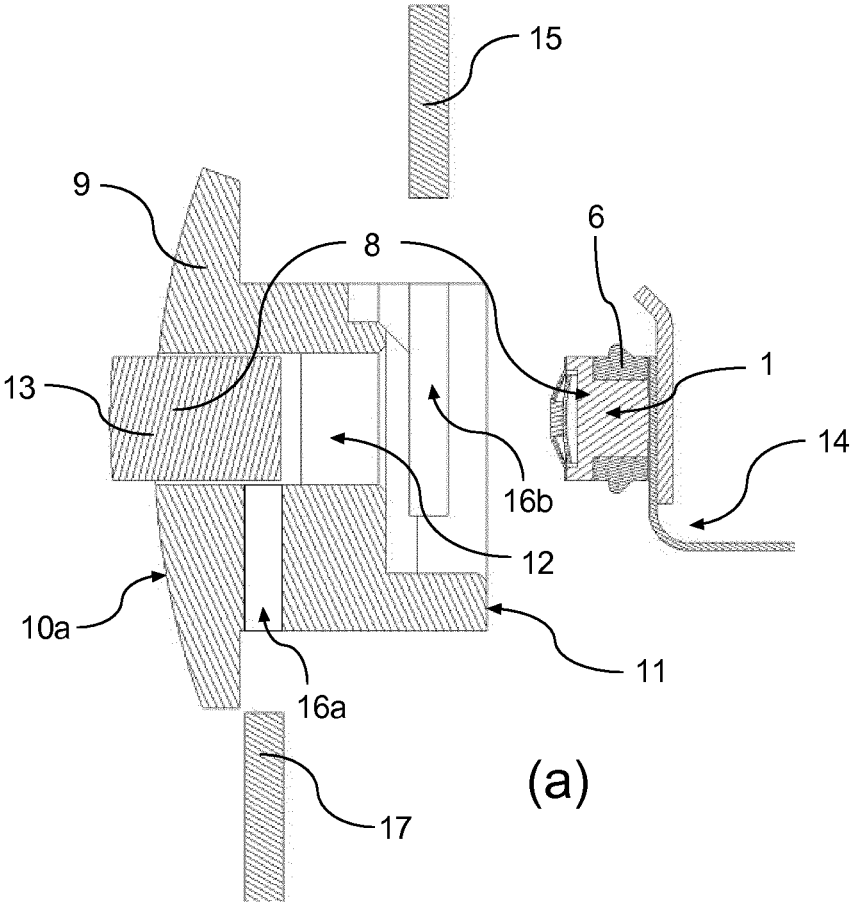
FIG. 4*a* shows a cross-sectional view of the button structure and housing shown in FIG. 3*b;*
FIG. 4*b* shows a cross-sectional view of the button structure and housing shown in FIG. 3*d;*
Figure 4:
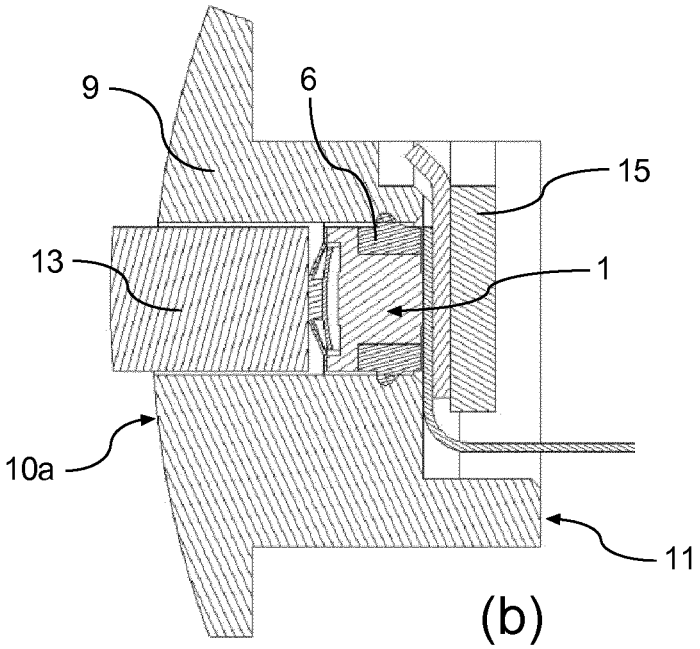

FIGS. 3 and 4 show embodiments of a button structure 8 arranged in an electronic device such as a mobile phone. The electronic device comprises a housing 9 which has a first external surface 10*a*, facing the exterior, and an opposing internal surface 11, facing the interior of the electronic device. The housing further comprises a second external surface 10*b* and a third external surface 10*c*, extending in parallel with each other and perpendicular to the first external surface 10*a* and the internal surface 11. The first external surface 10*a* and the internal surface 11 are connected by a through-going opening 12, extending essentially perpendicular to both surfaces. The first external surface 10*a* may be a planar surface, but it may also be somewhat curved, i.e. at least partially convex, as seen in FIGS. 4*a* and 4*b*. The internal surface 11 comprises at least one planar surface, i.e. it may comprise several parallel planar surfaces such that the internal surface 11 is a stepped surface.

The button structure 8 comprises the switch 1 and flex assembly 14 as described above, as well as a push-button 13 intended to protrude from the housing 9 of the electronic device. The switch 1 is configured to extend at least partially through the opening 12 between the push-button 13 and the flex assembly 14. As previously mentioned, the switch 1 is electrically connected to the flex assembly 14, e.g. by means of a soldering process such as reflow soldering.

The switch 1 comprises sealing means 6 configured to seal the opening 12 from ingress of fluid into the electronic device in a direction from the external surface 10*a* to the internal surface 11.

When providing an electronic device with a button structure 8, the push-button 13 is inserted into the opening 12 in a direction from the first external surface 10*a* towards the internal surface 11. The push-button 13 is inserted only partially such that it protrudes somewhat from the opening 12 and housing 9. The push-button 13 is thereafter attached to the housing 9 by means of a button lock plate 17.

The button lock plate 17 is inserted into a first groove 16*a*, which extends between the second external surface 10*b* and the opening 12. This is shown schematically in FIG. 4*a*. The second external surface 10*b* extends perpendicular to the first external surface 10*a*. The push-button 13 is configured to interlock with the button lock plate 17 such that the push-button 13 cannot be removed from the opening 12 without first removing the button lock plate 17 from the first groove 16*a*.

The switch 1 is inserted at least partially into the opening 12 in a direction from the internal surface 11 towards the first external surface 10*a*, and the flex assembly 14 is configured to eventually abut the internal surface 11, such that the flex assembly 14 stops the movement of the switch 1 through the opening 12. See FIGS. 3*b* and 3*c*. I.e., the switch 1 cannot extend past the external surface 10*a* due to the flex assembly 14 abutting the internal surface 11. The flex assembly 14 further comprises a support plate 15 configured to lock the flex assembly 14, and hence the switch 1, to the housing 9.

The support plate 15 is inserted into a second groove 16*b* which extends between the third external surface 10*c* and the opening 12, as shown in FIG. 3*d*. The third external surface 10*c* extends perpendicular to the first external surface 10*a* and parallel with the second external surface 10*b*. The support plate 15 is configured to interlock with the housing 9 such that the button structure 8 cannot be removed from the opening 12 without first removing the support plate 15 from the second groove 16*b*.

The various aspects and implementations has been described in conjunction with various embodiments herein. However, other variations to the disclosed embodiments can be understood and effected by those skilled in the art in practicing the claimed subject-matter, from a study of the drawings, the disclosure, and the appended claims. In the claims, the word "comprising" does not exclude other elements or steps, and the indefinite article "a" or "an" does not exclude a plurality. mere fact that certain measures are recited in mutually different dependent claims does not indicate that a combination of these measured cannot be used to advantage.

The reference signs used in the claims shall not be construed as limiting the scope.

The invention claimed is:

1. A waterproof switch comprising:
- a switch body comprising a first switch body section having a slot;
- a switch contact disposed in the slot;
- a switch contact cover covering the slot;
- a second switch body section adjacent to the first switch body section;
- a metal insert disposed within the second switch body section and configured for electrical coupling to an external conductor;
- a flex circuit assembly comprising:
- an L-shaped flexible flat cable electrically coupled to the metal insert; and
- a flex stiffener affixed to the flexible flat cable in a configuration for positioning the flex stiffener adjacent to a support plate; and
- a seal covering a circumference of the second switch body section.

2. The waterproof switch of claim 1, wherein a cross-section of the first switch body section is larger than a cross-section of the second switch body section.

3. The waterproof switch of claim 1, wherein the switch contact comprises a dome.

4. The waterproof switch of claim 1, wherein the seal comprises a gasket.

5. The waterproof switch of claim 1, wherein the seal comprises a circumferentially extending ridge.

6. The waterproof switch of claim 4, wherein the seal comprises material injection molded onto the switch body.

7. The waterproof switch of claim 1, wherein the housing comprises a single piece of machined material.

8. The waterproof switch of claim 1, wherein the metal insert is electrically coupled to a flexible flat cable.

9. A button structure for an electronic device comprising:
- a housing having an external surface and an internal surface;
- a through-going opening between the external surface and the internal surface;
- a push-button adjacent to the external surface;
- a flexible circuit assembly adjacent to the internal surface;
- a switch at least partially extending through the through-going opening between the push-button and the flexible circuit assembly, wherein the switch comprises:
  - a switch body having a first switch body section and a second switch body section, wherein the first switch body section comprises a slot, and wherein the second switch body section comprises a metal insert;
  - a switch contact disposed in the slot;
  - a switch contact cover covering the slot and the switch contact; and
  - a seal covering a circumference of the second switch body section;

an L-shaped flexible flat cable electrically coupled to the metal insert; and a flex stiffener affixed to the flexible flat cable in a configuration for positioning the flex stiffener adjacent to a support plate.

10. The button structure of claim 9, wherein the metal insert is electrically coupled to the flexible circuit assembly.

11. The button structure of claim 9, wherein the housing comprises a single piece of machined material.

12. The button structure of claim 9, wherein the seal is configured to seal the through-going opening from ingress of fluid into the housing.

13. The button structure of claim 9, wherein the switch is further configured for insertion into the through-going opening in a direction from an internal surface of the housing, and wherein the flexible circuit assembly is configured to abut the internal surface.

14. The button structure of claim 9, wherein the switch contact comprises a dome.

15. The button structure of claim 9, wherein the metal insert is electrically coupled to a flexible flat cable.

16. An electronic device, comprising:

a housing having a first external surface, a second external surface, a third external surface, and an internal surface, wherein the second external surface extends perpendicular to the first external surface;

a through-going opening between the first external surface and the internal surface;

a first groove extending from the second external surface to the through-going opening; and a button structure coupled to the housing and comprising:

a push-button adjacent to the through-going opening;

a button lock plate configured for interlocking with the push-button, wherein the push-button can be locked into or removed from the through-going opening by selectably positioning the button lock plate in the first groove;

a flexible circuit assembly adjacent to the through-going opening; and a switch configured to at least partially extend through the through-going opening between the push-button and the flexible circuit assembly, wherein the switch comprises:

a switch body comprising a first switch body section having a slot;

a switch contact disposed in the slot;

a second switch body section adjacent to the first switch body section;

a metal insert disposed within the second switch body section and configured for electrical coupling to an external conductor;

a switch contact cover covering the slot and the switch contact; and a seal covering a circumference of the second switch body section.

17. The electronic device of claim 16, wherein the third external surface of the housing extends parallel with the second external surface of the housing, and wherein the housing further comprises:

a second groove extending from the third external surface to the through-going opening; and a support plate configured for interlocking with the housing, wherein the button structure can be locked into or removed from the through-going opening by selectably placing or removing the support plate in the second groove.

18. The electronic device of claim 16, wherein the housing comprises a single piece of machined material.

19. The electronic device of claim 16, wherein a cross-section of the first switch body section is larger than a cross-section of the second switch body section.

20. The electronic device of claim 16, wherein the switch contact comprises a dome.

21. The electronic device of claim 16, wherein the metal insert is electrically coupled to a flexible flat cable.

* * * * *